US005944407A

United States Patent [19]

Lynch et al.

[11] Patent Number: 5,944,407

[45] Date of Patent: Aug. 31, 1999

[54] FLASHLIGHT/AREA TABLE LAMP HAVING A FLEXIBLE NECK

[75] Inventors: Peter F. Lynch, Skaneateles; Mark A. Ferguson, Jamesville; Robert L. Naas, Skaneateles, all of N.Y.; David R. Dalton, Westlake, Ohio

[73] Assignee: Eveready Battery Company, Inc., St. Louis, Mo.

[21] Appl. No.: 08/690,287

[22] Filed: Jul. 26, 1996

[51] Int. Cl.[6] ..... F21L 11/00

[52] U.S. Cl. ..... 362/198; 362/184; 362/413

[58] Field of Search ..... 362/197, 198, 362/199, 413, 427, 184

[56] References Cited

U.S. PATENT DOCUMENTS 3,681,590 8/1972 Dickie ..... 362/198
3,962,678 6/1976 Kurokawa ..... 362/275
4,443,831 4/1984 Godfrey et al. ..... 362/80
5,517,392 5/1996 Rousso et al. ..... 362/198

*Primary Examiner*—Stephen Husar
*Attorney, Agent, or Firm*—Robert W. Welsh; S. Allan Fraser

[57] ABSTRACT

An illumination device functioning as both a flashlight and an area table lamp having a flexible neck that connects a light housing to a base. The illumination device includes at least one light source mounted in the light housing for projecting light through either a diffusing lens to function as an area light or a projecting lens to function as a flashlight. An improved flexible neck for an illumination device is also disclosed that has a dampening mechanism and a retaining mechanism disposed in an elongated solid resilient body. The retaining mechanism counters the resilient force of the resilient body to retain a selected position of the flexible neck while the dampening mechanism serves to dampen a bouncing effect that commonly occurs in flexible necks of flashlights.

46 Claims, 5 Drawing Sheets

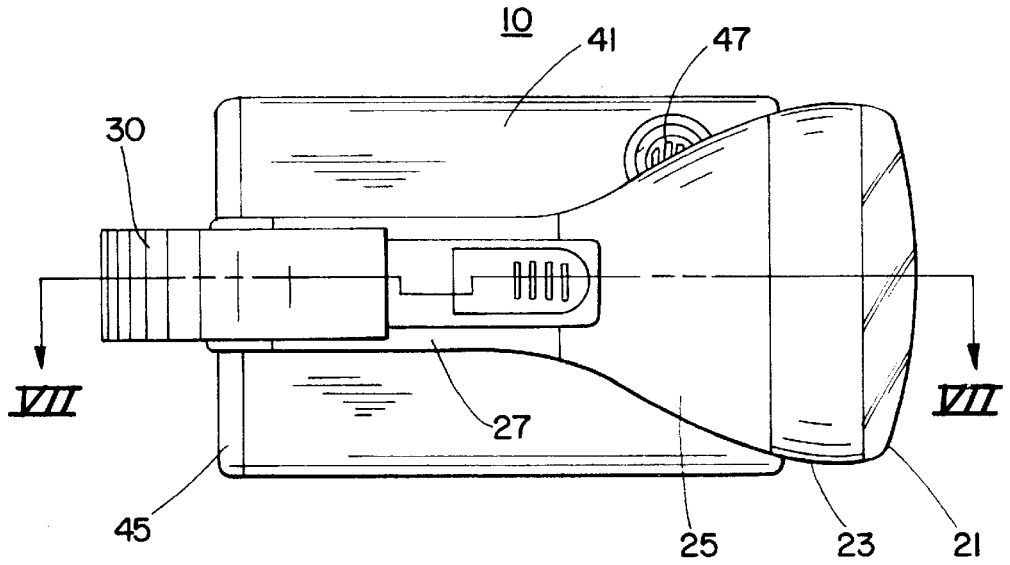
Fig. 6
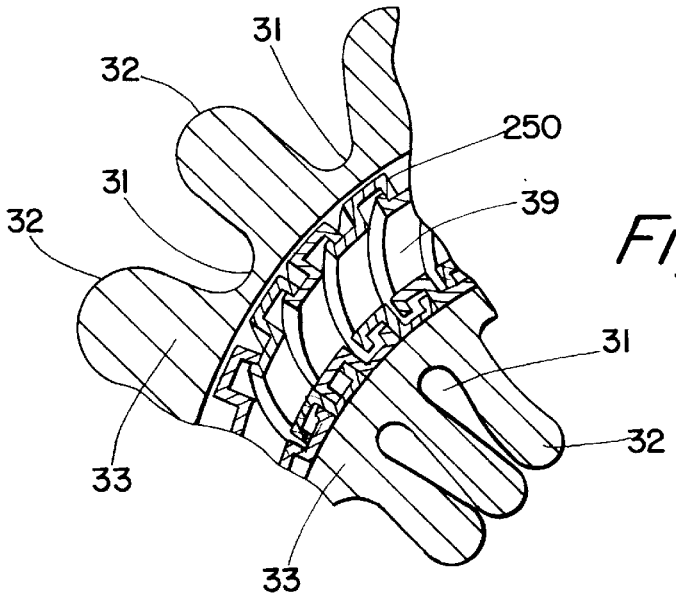
Fig. 8
Fig. 9
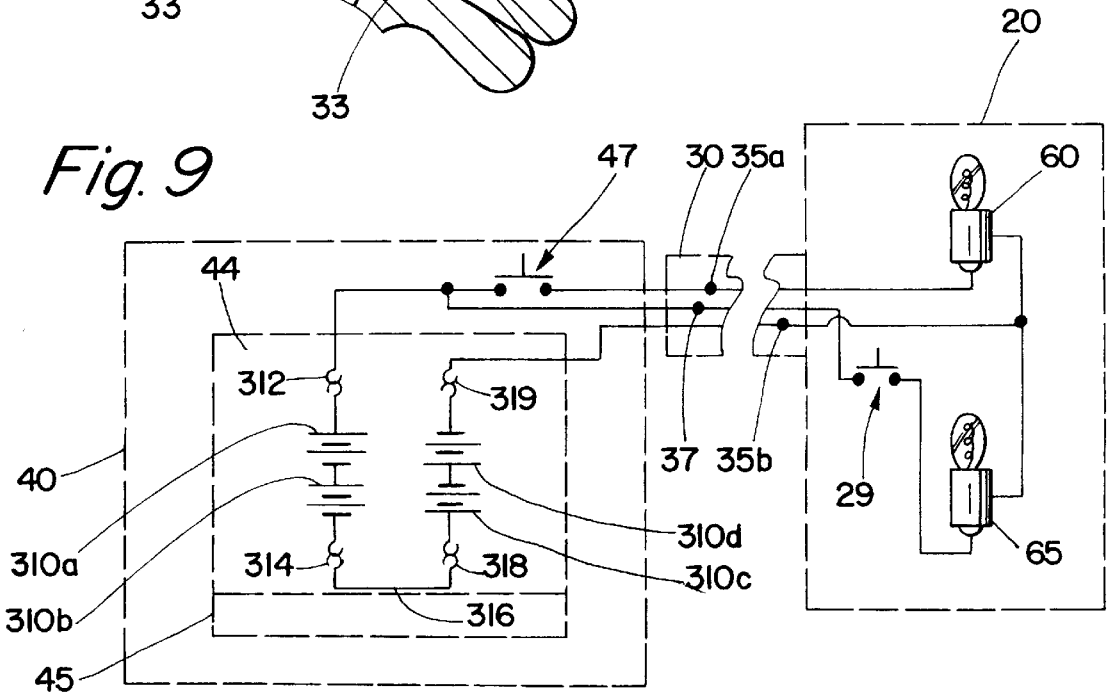

FLASHLIGHT/AREA TABLE LAMP HAVING A FLEXIBLE NECK

BACKGROUND OF THE INVENTION

The present invention generally relates to a flashlight or area table lamp having a flexible neck. Further, the present invention relates to an illumination device functioning as both a flashlight and an area table lamp.

Portable illumination devices such as flashlights and lanterns have gained wide acceptance for a variety of uses. Such portable illumination devices are very useful for camping, hiking, and performing common household and automotive maintenance tasks. Portable illumination devices take various forms including a directive illumination device, such as a flashlight or directive lantern and an area light or area lantern of the type which typically includes a strap or handle above the light source and emits illumination 180–360 degrees radially from the light source. Such area lights may include incandescent or fluorescent light sources or may include a gas burner element. Due to the diverse manners in which such portable illumination devices may be used in any one environment, one type of illumination device may be more suitable for one particular use than the other type of illumination device. For example, directive lights (i.e., flashlights) are better suited for hiking along a trail because they provide greater illumination intensity in a particular direction, whereas area lights are better suited for providing area illumination of a campsite. Thus, campers typically resort to purchasing and using separate flashlights and area lights. When used for hiking, the need to pack two separate illumination devices takes up precious space in the hiker's backpack and adds additional weight that must be carried.

To eliminate the need for two separate portable illumination devices, portable illumination devices have been developed that function as both a flashlight and an area light. Such combination portable illumination devices may include two separate light sources such as an incandescent flashlight bulb and a fluorescent tube for area illumination, or they may include a single incandescent light source that is dynamically movable between two positions so as to emit illumination from behind one of two different lenses.

Another form of portable illumination device is a flashlight formed with a flexible core. Examples of such flashlights are disclosed in U.S. Pat. No. 3,393,311 issued to F. L. Dahl on Jul. 16, 1968, entitled ADJUSTABLE TROUBLE LAMP MEANS; U.S. Pat. No. 5,517,392 issued to John G. Rousso et al. on May 14, 1996, entitled SLEEVE RETENTION FOR FLEXIBLE CORE OF A FLASHLIGHT; and U.S. Pat. No. 5,521,803 issued to Lee H. Eckert et al. on May 28, 1996, entitled FLASHLIGHT WITH FLEXIBLE CORE. Such flashlights utilize a flexible core to enable the flashlight head to be positionally manipulated to illuminate a desired location. Some of these flexible core flashlights further enable the flashlight to be wrapped around a pole or the like to enable hands-free manipulation of the object that is being illuminated. Such flashlights, however, are not particularly well-suited for illuminating a wide area due to their optical elements that direct the illumination primarily in a single direction. These flexible core flashlights are particularly ill-suited for area illumination of a table top when the only location to place the flashlight is on the same table top. Further, when such flexible core flashlights are placed on a surface and the flashlight head is moved, the flashlight head exhibits an undesirable bouncing effect.

SUMMARY OF THE INVENTION

The present invention solves the above problems and provides an illumination device with a flexible neck capable of functioning as both a flashlight and an area table lamp. Another aspect of the present invention is to provide an illumination device having a light housing that may be moved from a position suitable for using the illumination device as a flashlight to a position suitable for using the device as a table top area light.

To achieve these and other advantages, and in accordance with the purpose of the invention as embodied and described herein, the illumination device of the present invention comprises a first light source, a second light source, and a light housing for housing the first and second light sources. The light housing includes a lens for focusing illumination from the first light source to a spot as well as a diffusing lens for dispersing diffused illumination from the second light source over a wide area. The illumination device further includes a base and a flexible neck physically and flexibly connecting the light housing to the base such that the light housing may be selectively positioned to function as either an area lamp or a flashlight.

The base may include a battery receptacle for receiving at least one battery and battery terminals for contacting the poles of a battery placed in the receptacle. The flexible neck provides an electrical pathway for electrically coupling the battery terminals to the first and second light sources to selectively supply power to the first and second light sources from at least one battery placed in the battery receptacle. The illumination device may also include a first switch mounted on the light housing for selectively providing power to the first light source, and a second switch mounted on the base for selectively providing power to the second light source.

Another aspect of the present invention is to provide an improved flexible neck for an illumination device. Yet another aspect of the present invention is to provide a dampening mechanism for a flexible neck of a flashlight to reduce bouncing of the housing in which the light source is mounted.

To achieve these additional aspects and other advantages, and in accordance with the purpose of the invention as embodied and described herein, the flexible neck of the present invention physically and flexibly connects a lighting member to a base of an illumination device, and comprises an elongated resilient body having a first end connected to the lighting member and a second end connected to the base. The resilient body has first and second longitudinal holes extending from the first end to the second end. The flexible neck further includes retention means disposed in the first longitudinal hole through the resilient body to retain a selected positional relationship between the lighting member and the base, and dampening means disposed in the second longitudinal hole through the resilient body for dampening movement of the flexible neck.

Additionally, the resilient body may have a third longitudinal hole extending from the first end to the second end for receiving second retention means. In a preferred embodiment, the first and second retention means are each formed of a metal rod and the dampening means is formed of flexible conduit. Further, the resilient body is preferably formed of polyvinyl chloride. Alternatively, the resilient body may be formed of natural rubber, flexible synthetic rubber or hard synthetic rubber.

These and other features, objects, and benefits of the invention will be recognized by those who practice the invention and by those skilled in the art, from reading the following specification and claims together with reference to the accompanying drawings.

BRIEF DESCRIPTION OF THE DRAWINGS

In the drawings:

FIG. 6 is a top elevational view of the illumination device of the present invention;

FIG. 8 is a magnified view of section VIII as indicated in FIG. 7A; and

FIG. 9 is an electrical schematic diagram of the electric circuitry used in the illumination device of the present invention.

DETAILED DESCRIPTION OF PREFERRED EMBODIMENTS

Figure 1:
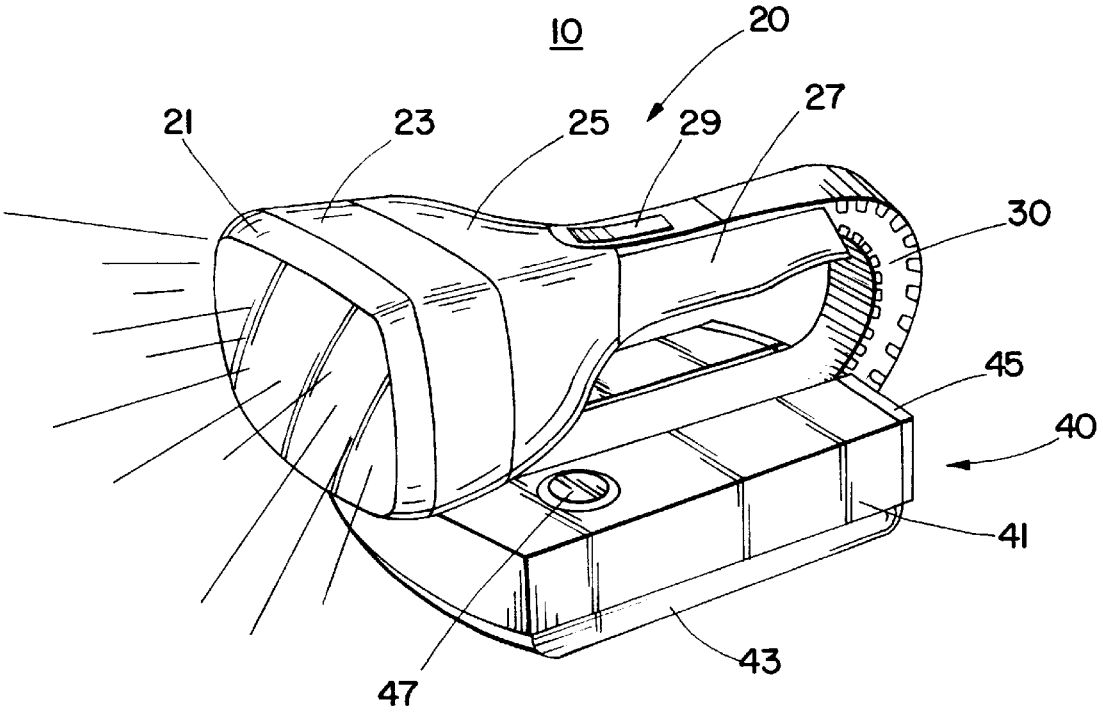
FIG. 1 is a perspective view of the illumination device of the present invention shown in use as a flashlight.
Figure 2:
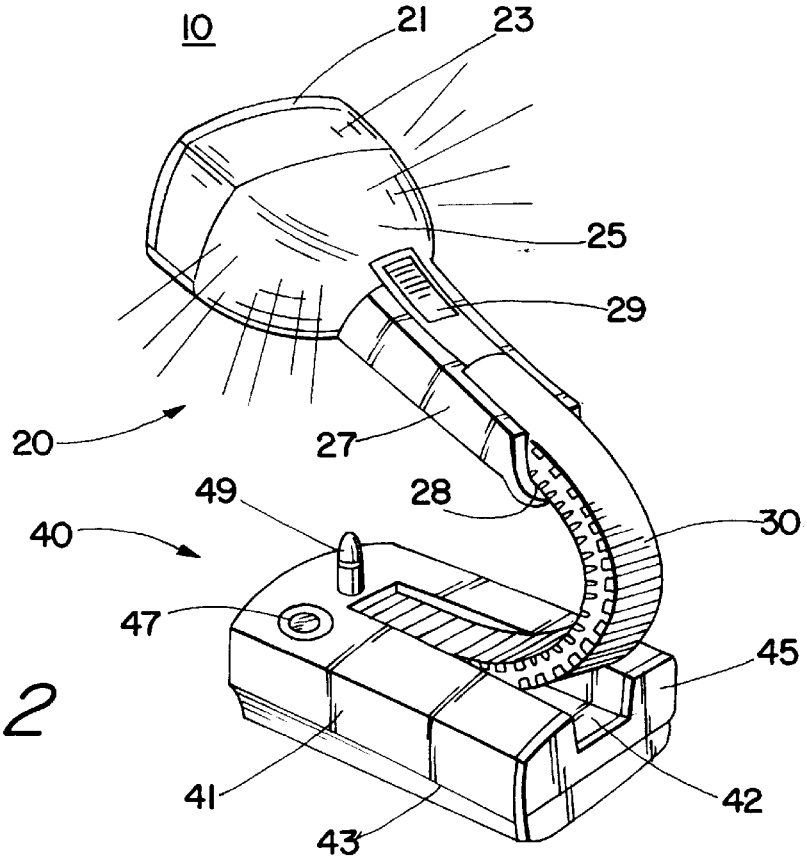
FIG. 2 is a perspective view of the illumination device of the present invention in use as an area table lamp.

As stated above, the present invention is directed to an illumination device having a flexible neck and functioning as both a flashlight and an area table lamp. FIG. 1 shows the illumination device 10 of the present invention in a position best suited for use as a flashlight. FIG. 2 shows illumination device 10 in a position suitable for use as an area lamp. As shown in these and the other drawing figures, illumination device 10 includes a light housing portion 20 for housing at least one light source, a base portion 40, which preferably houses batteries for powering the light source, and a flexible neck 30 physically connecting base 40 and light housing 20 and formed of a resilient body for enabling light housing 20 to be selectively positioned relative to base 40. Preferably, light housing 20 is an integrally formed member including a handle portion 27, a tapered diffusing lens 25, a collar 23, and a protecting lens 21. Light housing 20 may also include a switch 29 preferably of the push-button or sliding type for supplying energy to at least one light source positioned in light housing 20. As described in greater detail below with respect to FIGS. 7A and 7B, handle portion 27 is preferably formed in a shape form-fitted to the typical human hand about its periphery while having a U-shaped end portion 28 for receiving one end of flexible neck 30. Switch 29 is preferably disposed on an upper and opposite end of handle portion 27 in a location easily manipulated by a user's thumb.

Diffusing lens 25 is preferably attached at one end to the end of handle portion 27 opposite the end which receives flexible neck 30. The preferred construction of diffusing lens 25 is that having a narrow end conforming to the size of the end of handle portion 27 and tapering outward to engage a first end of opaque collar 23, which has a wider cross-sectional area and a rectangular shape with rounded corners. As apparent from the drawing figures, diffusing lens 25 is substantially transparent and is 360 degrees about an axis extending longitudinally through handle portion 27. Diffusing lens 25 may be made of clear or frosted plastic or glass. Opaque collar 23 may be of any suitable width and generally provides an ascetic separation of diffusing lens 25 and protecting lens 21 while hiding from external view a reflector 70 (FIGS. 7A and 7B) as well as the seams and mounting means between lenses 25 and 21.

A protecting lens 21 is disposed at the opposite opening of collar 23 and projects illumination in a forward direction along an optical axis A (FIG. 3) that is parallel to an axis B extending through handle portion 27. Projecting lens 21 may be of any conventional construction for a generally rectangular-shaped flashlight or lantern. Although the present invention is described as including a generally rectangular shape with rounded edges for the light housing 20, it will be appreciated by those skilled in the art that light housing 20 may take other forms, shapes, and dimensions without departing from the scope of the invention.

Figure 3:
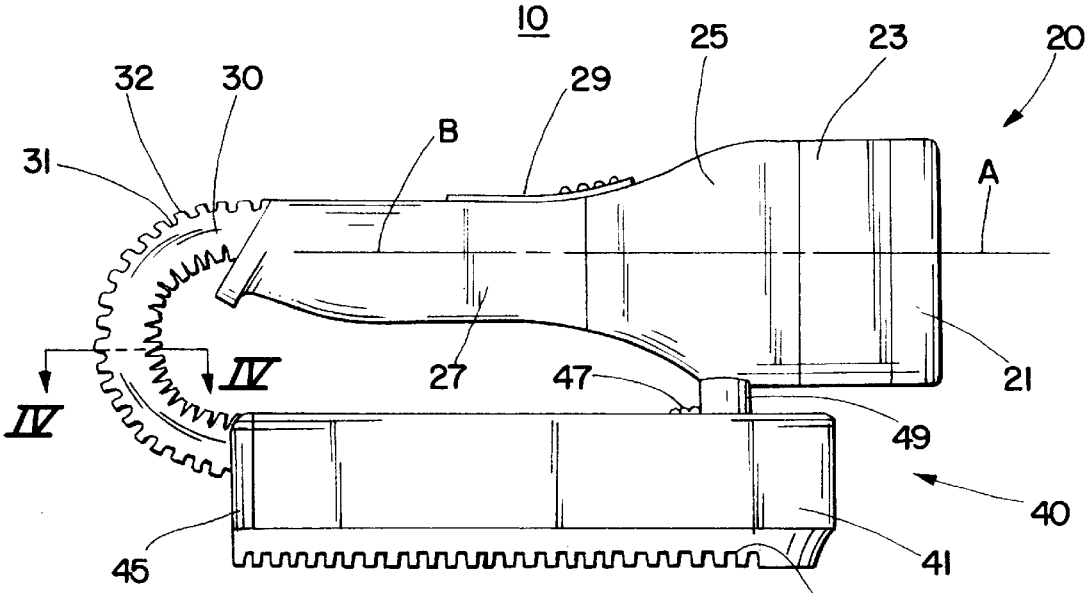
FIG. 3 is a side elevational view of the illumination device of the present invention.

Base 40 preferably includes an outer base housing 41 having a U-shaped recess 42 extending across a substantial portion of the top surface of base 40 to one end thereof for receiving flexible neck 30. Base 40 further includes a bottom surface foot portion 43 formed across the bottom of base housing 41. Foot portion 43 is preferably formed of a hard rubber or other gripping-type material for preventing base 40 from undesirable sliding on a table top or other surface. Preferably, as shown in FIG. 3, foot portion 43 is formed with a plurality of parallel grooves to further prevent slippage.

One end of base 40 is preferably formed with a battery receptacle door 45 which may be fastened to base housing 41 in any conventional manner or, as described below with respect to FIG. 7A, battery receptacle door 45 may be integrally formed as a removable tray that may be slid out from base housing 41 to insert and remove batteries therefrom prior to inserting the batteries and tray into base housing 41.

Housing 40 also preferably includes a second switch 47 for selectively supplying power from the batteries placed in the battery receptacle to a light source mounted in light housing 20. More particularly, switch 47 selectively turns on and off a first light source 60 (FIGS. 7A and 7B) mounted in light housing 20 so as to emit light radially and outwardly through diffusing lens 25 and light switch 29 selectively turns on and off a second light source 65 mounted in a forward portion of light housing 20 for emitting light through protecting lens 21.

A coupling structure 49 is also preferably disposed on an upper surface of base housing 41 for removably coupling light housing 20 to base 40 as shown in FIGS. 1, 3, 5, 7A, and 7B. By providing such coupling means 49 between light housing 20 and base 40, light housing 20 may be rigidly and removably secured to base 40 thereby enabling illumination device 10 to be readily transported and carried in a position most suitable for use as a flashlight while light is projected outwardly from protecting lens 21. By providing the coupling means 49 using such a structure that allows light housing 20 to be removed from base 40, light housing 20 may be positionally manipulated relative to base 40 so as to elevate light housing 20 above base 40 in a position similar to that shown in FIG. 2 which is especially well-suited for use as a table top area light when light is emitted through diffusing lens 25. Although only two relative positions of light housing 20 and base 40 are shown, flexible neck 30 permits twisting and movement in virtually any direction such that light housing 20 may be positionally manipulated to provide illumination in any desired area.

As shown in FIG. 3, flexible neck 30 is preferably formed with a plurality of parallel grooves 31 that define a plurality of parallel ridges 32. As apparent in FIG. 3, grooves 31 enable bending of flexible neck 30 by allowing compression of the exterior portion of the resilient body forming the flexible neck along the inner portion of the bend while allowing expansion of the exterior surface portion along the outer bend in flexible neck 30.

Figure 4A:
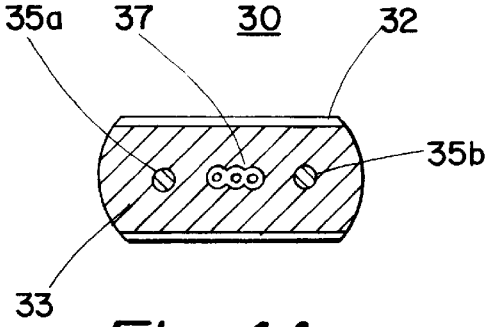
FIG. 4A is a cross section of a first embodiment of flexible neck 30 taken along line IV—IV shown in FIG. 3.
Figure 4B:
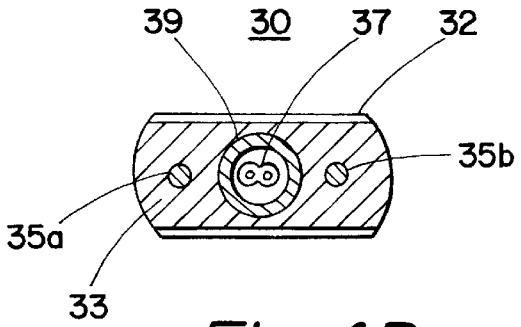
FIG. 4B is a cross section of a second embodiment of flexible neck 30 taken across line IV—IV shown in FIG. 3.
Figure 5:
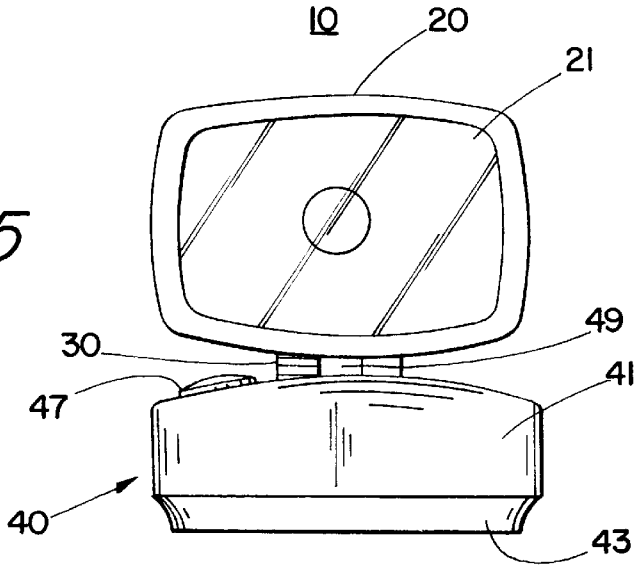
FIG. 5 is a front elevational view of the illumination device of the present invention shown in the best suited position for use as a flashlight.

A cross section of flexible neck 30, taken along line IV—IV in FIG. 3, is shown in FIGS. 4A and 4B to illustrate two respective embodiments of flexible neck 30. The first embodiment of the flexible neck 30 includes a solid resilient body 33 that is preferably formed of a material such as polyvinyl chloride. If desired, a hard flexible synthetic rubber may be used instead of polyvinyl chloride. An example of such a suitable synthetic rubber is that sold under the trademark KRATON available from Shell Oil Company. Flexible neck 30 also includes a first conductive metal rod 35*a* and a second conductive metal rod 35*b* both of which extend from one end of flexible neck 30 to the other to provide an electrical connection between the battery contact terminals in base 40 and the light sources in light housing 20. Conductive metal rods 35*a* and 35*b* are preferably disposed in respective first and second longitudinal holes of the same diameter extending from one end of resilient body 33 to the other. Conductive metal rods 35*a* and 35*b* are preferably 18 gauge copper wire although other gauges of copper or other metal wire may be used so long as it has sufficient durability so as not to break and sufficient strength to retain resilient body 33 in a desired position.

Flexible neck 30 also preferably includes an insulated wire 37 extending through a third longitudinal hole in resilient body 33 to provide an electrical connection to a second light source mounted in light housing 20. By providing three wires extending through flexible neck 30, switch 47 may be provided in base 40 to selectively turn on and off one of the two light sources mounted in light housing 20. It will be understood by those skilled in the art, however, that switch 47 could be positioned on light housing 20 such that only two wires need to be provided through flexible neck 30.

The second and more preferred embodiment of flexible neck 30 is shown in FIG. 4B and differs from the first embodiment in that flexible metal conduit 39 is provided in the third longitudinal hole extending through resilient body 33 lying between the first and second conductive metal rods 35*a* and 35*b*. Again, the diameter of the third longitudinal hole in resilient body 33 is substantially the same diameter as the outer diameter of flexible conduit 39. As shown in FIG. 4B, the third conductor 37 may be fed through the hollow interior of flexible conduit 39. Flexible conduit 39 may be any form of conventional flexible conduit of the type commonly used for desk lamps and the like and is preferably coated on its exterior surface with an insulating plastic so as to reduce noise caused by flexible conduit 39 sliding in the longitudinal hole of resilient body 33. By providing flexible conduit 39 in neck 30, additional means for retaining the position of neck 30 is provided. Additionally, flexible conduit 39 acts as a dampening mechanism for reducing the bouncing that occurs when light housing 20 is initially moved relative to base 40. Further, flexible conduit 39 may also be used as a conductor for providing an electrical connection between the batteries and one of the light sources. A detailed description of conduit 39 is provided below with reference to the cross section of conduit 39 in FIG. 8.

As will be appreciated by those skilled in the art, flexible neck 30 may be formed using conventional injection molding or extruding techniques to mold resilient body 33 about conductive metal rods 35*a* and 35*b* and flexible conduit 39. Third conductor wire 37 may be fed through flexible conduit 39 either before or after resilient body 33 is molded in place.

Having generally described the components of the illumination device of the present invention, a detailed description of one embodiment of the illumination device will now be described with reference to the cross section shown in FIG. 7A, which is taken along line VII—VII in FIG. 6. As shown in FIG. 7A, light housing 20 preferably has mounted therein two separate light sources 60 and 65, which may be conventional flashlight bulbs. First light source 60 is mounted to an end portion of diffusing lens 25 so as to project light through diffusing lens 25 360 degrees outward from the sides of light housing 20. Light source 65 is preferably mounted in a reflector 70 serving to reflect and direct all of the illumination impinging thereon towards protecting lens 21. Reflector 70 may be formed of any conventional reflective material normally used for such flashlight reflectors. Additionally, the back side of reflector 70 may be reflective to direct more light from light source 60 radially through diffusing lens 25.

Two metal posts 74 and 76 are provided between the end of diffusing lens 25 in the vicinity of light source 60 and an end reflector 70 in the vicinity of light source 65 to provide additional support within light housing 20 and to provide a means of electrical connection to light source 65. Preferably, posts 74 and 76 have a thin profile so that they do not cause excessive shadowing to appear on diffusing lens 25. Alternatively, the electrical connection to light source 65 may be provided by two insulated wires mounted to posts 74 and 76.

Handle portion 27 may be formed using a two-piece construction whereby an upper housing 27*a* is mounted to a lower housing 27*b* using screws or bolts 110 extending into a threaded interior extension 114 of upper housing 27*a* through a recessed bore 112 in lower housing 27*b*. Upper housing 27*a* also preferably includes at least one threaded interior extension 122 that may be extended through a lateral hole 124 provided in an end of flexible neck 30 for receiving a screw or bolt 120 which compresses the end of flexible neck 30 using a washer 126 provided in a wider bore at one end of the lateral hole 124. By providing one or more of these screws in each end of flexible neck 30, the neck may be securely fastened to light housing 20 and base 40.

Upper housing 27*a* also preferably includes an interior extension plate 134 abutting an end of diffusing lens 25 and including a threaded hole 130 for receiving a bolt or screw 132 which extends through a hole in the end of diffusing lens 25 to secure lens 25 to handle portion 27.

Figure 7A:
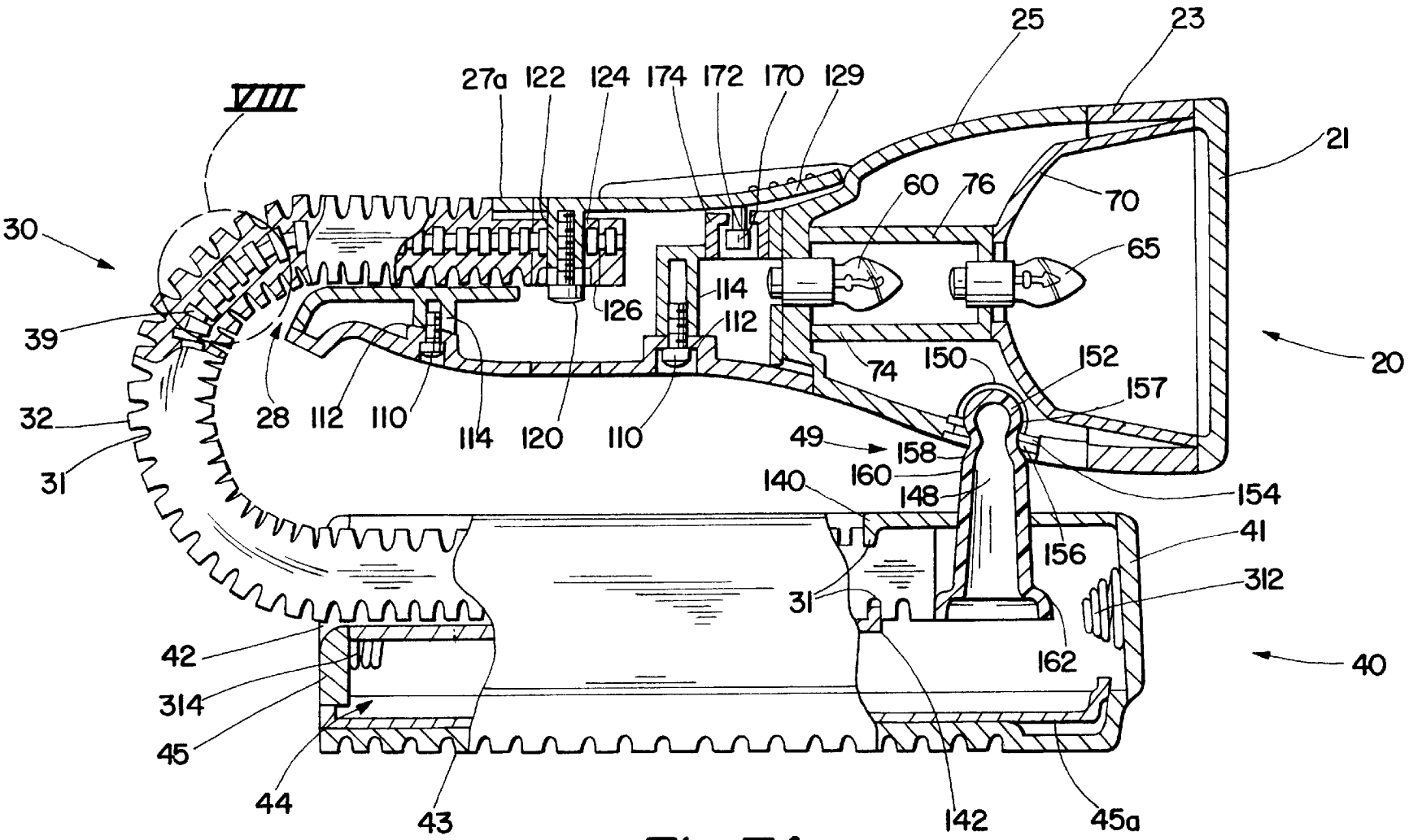
FIG. 7A is a partial cross section of a first embodiment of the illumination device taken along line VII—VII in FIG. 6.

Switch 29 may be of a sliding or push-button type design and, as shown in FIG. 7A, includes a contact housing 170 and a plunger 172, which is pushed downward into contact housing 170 by external pressure applied downwardly to switch 29. Contact housing 170 may have a spring latch included therein for latching the contacts in a closed position until switch 29 is subsequently pressed. It will be appreciated, however, that other switching mechanisms may be employed. Further, although the construction of switch 47 is not shown in the drawings, the construction of switch 47 may be similar to that shown in FIG. 7A for switch 29. As shown in FIG. 7A, an interior clip 174 may be provided on upper housing 27*a* for receiving contact housing 170 and securing it in place inside handle portion 27.

The other end of flexible neck 30 is secured in place in base 40 utilizing a first lip 140, which is a downward extension of base housing 41, for extending into a groove 31 of flexible neck 30 at an end of recess 42. A second lip 142 is also provided to extend upward from a lower portion of recess 42 at the same end thereof and oppositely opposed to first lip 140 to extend into a groove 31 formed in flexible neck 30. Additionally, lateral holes may be provided in this end of flexible neck for receiving a mounting screw or bolt in the same manner in which the other end of flexible neck 30 is mounted to light housing 20.

As mentioned above, battery receptacle door 45 is preferably fixedly mounted to a tray 45*a* which may be slid outwardly from base housing 41 for placing or removing batteries therefrom for subsequent insertion into battery receptacle 44 defined within base 40. Preferably, battery receptacle 44 in tray 45*a* holds four D-sized alkaline batteries with two batteries on either side of recess 42. The inside of battery receptacle door 45 may be provided with a battery contact terminal strip 316 (FIG. 9) extending from the positive pole of a battery placed on one side of recess 42 to the negative pole of another battery placed on the other side of recess 42 so as to provide a series connection between all four of the batteries inserted in receptacle 44. In this manner, the negative and positive battery contact terminals that are connected to conductors 35*a,* 35*b,* and 37 may be disposed at the interior end of base 40 proximate the location where the conductors enter the interior of base 40 from flexible neck 30.

Figure 7B:
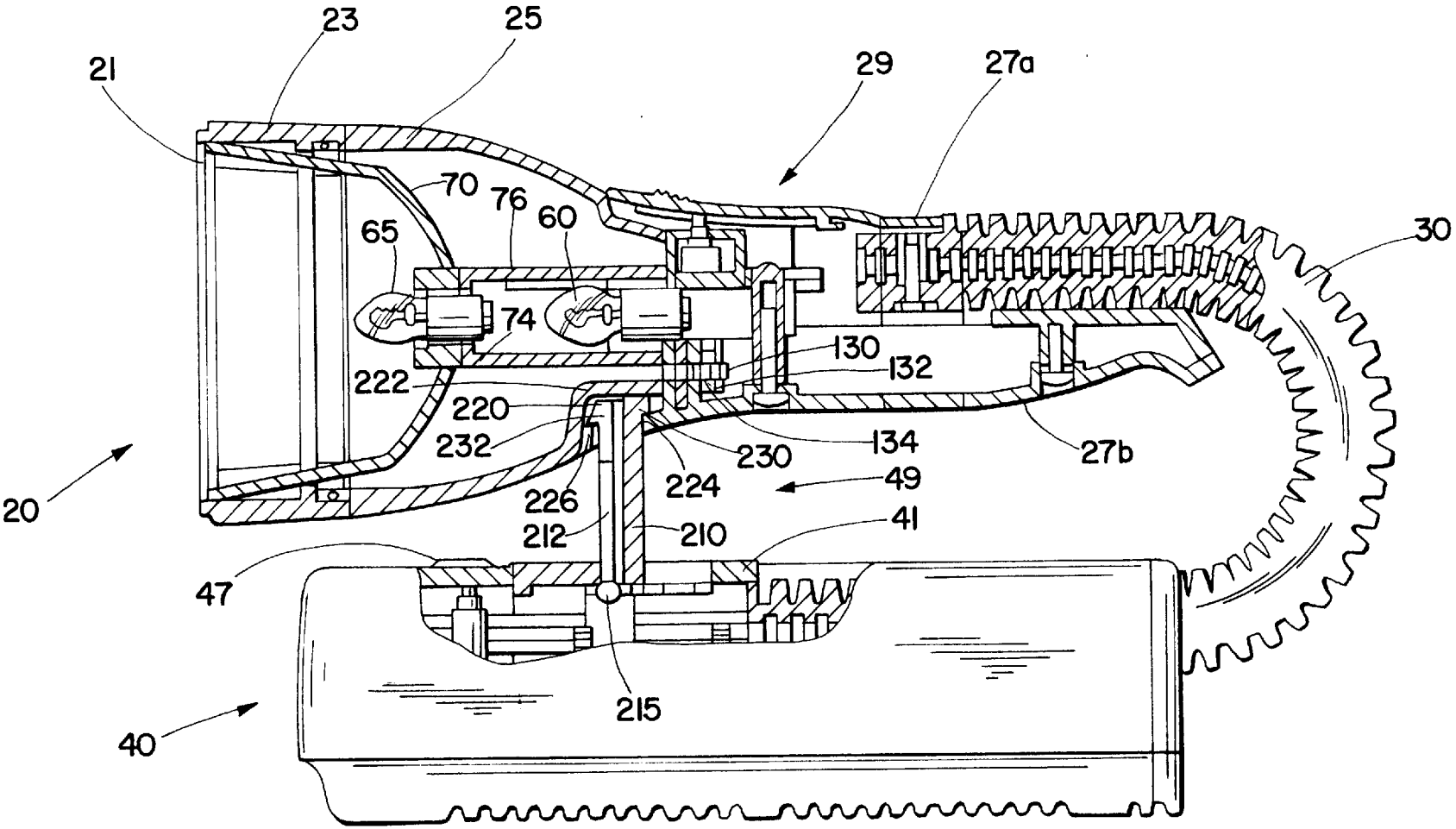
FIG. 7B is a partial cross section of a second embodiment of the illumination device.

As described above, coupling mechanism 49 provides a rigid connection between base 40 and light housing 20 to enable illumination device 10 to be easily carried using handle portion 27 in a position most suitable for use as a flashlight. Coupling mechanism 49 may be of any construction suitable for accomplishing this task provided the mechanism is sufficiently durable to withstand frequent use. Two different embodiments of coupling mechanism 49 are shown in FIGS. 7A and 7B, respectively. In the first embodiment shown in FIG. 7A, coupling mechanism 49 includes a male portion 148 mounted within base 40. Male portion 148 is removably inserted into a female portion 150 formed in the bottom of light housing 20. In this particular embodiment, male portion 148 includes a shaft 160 mounted in the interior of base 40 using mounting screws (not shown) extending through a lateral, perpendicular base 162 integrally formed with shaft 160. Male portion 148 further includes a head 152 which is integrally formed with a tapered portion 158 of shaft 160 so as to define a ridge 151 about the lower periphery of head 152.

Female portion 150 of coupling mechanism 49 includes a hollow recess formed in diffusing lens 25 or alternatively in collar 23 for receiving the head 152 of male portion 148. Female portion 150 further includes a rubber grommet 154 disposed in the opening of female portion 150 to resiliently allow head 152 to be inserted in a hole formed therein while constricting about the narrow portion 158 of shaft 160 just beneath ridge 151 of head 152 to securely grip and hold in place male member 148.

A second embodiment of the illumination device is shown in cross section in FIG. 7B. In this second embodiment, a different more preferred coupling mechanism 49 is employed. In this embodiment, coupling mechanism 49 includes a clipping structure including a first clip 210 fixedly secured to the top of base housing 41 and a second clip 212 pivotally coupled to the top surface of base housing 41 about a pivot pin 215 secured in base 40. First and second clips 210 and 212 extend upwardly from the top surface of base 40 in parallel for selective insertion into a female portion 220 formed as an opening in lower handle housing 27*b*. An interior extension 222 of diffusing lens 25 defines female portion 220 within light housing 20. Preferably, female portion 220 includes a first lip 224 and a second lip 226 that extend into the opening in lower handle housing 27*b* to engage respective outward protrusions 230 and 232 formed on clips 210 and 212, respectively. Preferably, second clip 212 is biased by a spring (not shown) or other mechanism to move apart from first clip 210 so as to ensure the engagement of lips 224 and 226 with protrusions 230 and 232. In this manner, clips 210 and 212 would secure themselves inside the opening in light housing 20 upon insertion until clips 210 and 212 are pinched together to disengage lips 224 and 226.

It will be appreciated by those skilled in the art that second clip 212 could also be fixedly secured to base housing 41 provided at least one of clips 210 and 212 are formed of materials that are sufficiently flexible and resilient to be repeatedly pinched together without effecting the force at which clips laterally engage lips 224 and 226. Further, with respect to both coupling mechanisms shown in FIGS. 7A and 7B, the male portions could be mounted to the light housing 20 and the female portions formed in base 40.

FIG. 8 shows a magnified portion of FIG. 7A indicated by VIII. The magnified portion illustrates a cross section of flexible conduit 39. As shown in this figure, flexible conduit 39 includes a spirally-wound outer strip 250 forming a helix having edge portions thereof movably interconnected and effectively joined together to form an effective expansion and contraction joint therebetween. Preferably, flexible conduit 39 has a ¼-inch outside diameter although other sizes of flexible conduit may be used provided it fits within resilient body 33. Further, other equivalent structures could be used such as a sufficiently-flexible tube of metal or plastic provided that such equivalent structure dampens the movement of flexible neck 30 when it is moved from one position to another.

FIG. 9 shows the electric circuitry utilized in the illumination device of the present invention. The electric circuit preferably includes four D-size batteries 310*a*–310*d* disposed in battery receptacle 44 of base 40 with two batteries inserted on either side of recess 42 in housing 40. As shown in FIG. 9, two of the batteries are inserted negative poles first while the other two batteries are inserted positive poles first. In this manner, a first battery 310*a* has its negative pole in contact with the positive pole of a second battery 310*b* and has its positive pole in contact with a battery terminal 312 mounted in battery receptacle 44. Battery terminal 312 is electrically connected to one terminal of switch 47 and to one end of electrical conductor 37, which extends through flexible neck 30 to one terminal of switch 29 in light housing 20. The negative pole of second battery 310*b* contacts a battery terminal 314 of a conductive strip 316 mounted on the interior surface of battery receptacle door 45. Conductive strip 316 also includes a battery terminal 318 positioned to contact the positive pole of a third battery 310*c* thereby connecting battery 310*c* in series with first battery 310*a* and second battery 310*b*. The negative pole of third battery 310*c* contacts the positive pole of a fourth battery 310*d* disposed in the same side of battery receptacle 44. The negative pole of fourth battery 310*d* contacts a battery terminal 319 disposed in the same end of battery receptacle 44 as battery terminal 312. Battery terminal 319 is electrically connected to conductive metal rod 35*b* which extends through flexible neck 30 to the negative terminals of light sources 60 and 65 disposed in light housing 20. The positive terminal of first light source 60 is electrically coupled to a second terminal of switch 47 by conductive metal rod 35*a* extending through flexible neck 30. The positive terminal of second light source 65 is coupled to the second terminal of switch 29. As discussed above, switches 47 and 29 can be disposed in either base 40 or light housing 20 or alternatively could be replaced with a single three- or four-position switch to selectively provide power to one or both of light sources 60 and 65. Battery terminals 312, 314, 318, and 319 may be formed of any combination of conventional battery terminals such as springs and flexible metal plates.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. An illumination device comprising:

a lighting member for housing a light source and a diffusing lens cooperating with said light source to emit light radially outwardly from said lighting member;

a base; and a flexible neck physically and flexibly connecting said lighting member to said base, said flexible neck including an elongated resilient body having a first end connected to said lighting member and a second end connected to said base, retention means for retaining a selected positional relationship between said lighting member and said base, and dampening means for dampening movement of said flexible neck.

2. The illumination device as defined in claim 1, wherein said base includes a battery receptacle for receiving a battery and battery terminals disposed in said battery receptacle for contacting the poles of a battery placed in said battery receptacle.

3. The illumination device as defined in claim 2, wherein said flexible neck provides an electrical pathway for electrically coupling said battery terminals to said light source to selectively supply power to said light source from at least one battery placed in said battery receptacle.

4. The illumination device as defined in claim 3, wherein said retention means is an electrical conductor for electrically coupling one of said battery terminals to said light source.

5. The illumination device as defined in claim 1, wherein said resilient body has first and second longitudinal holes extending from said first end to said second end, said retention means is disposed in said first longitudinal hole through said resilient body, and wherein said dampening means is disposed in said second longitudinal hole through said resilient body.

6. The illumination device as defined in claim 5, wherein said resilient body further includes a third longitudinal hole extending from said first end to said second end and said flexible neck further includes second retention means disposed in said third longitudinal hole.

7. The illumination device as defined in claim 6, wherein both of said retention means are electrical conductors for electrically coupling said battery terminals to said light source.

8. The illumination device as defined in claim 7 and further including a switch for selectively supplying power to said light source.

9. The illumination device as defined in claim 8, wherein said switch is mounted on said light housing.

10. The illumination device as defined in claim 8, wherein said switch is mounted on said base.

11. The illumination device as defined in claim 1, wherein said resilient body is formed of hard rubber.

12. The illumination device as defined in claim 1, wherein said retention means is formed of metal wire.

13. The illumination device as defined in claim 1, wherein said dampening means is flexible conduit extending substantially uninterrupted between said first end and said second end of said elongated resilient body.

14. An illumination device comprising:

a lighting member for housing a light source and a lens;

a base including a battery receptacle for receiving a battery and first and second battery terminals for respectively contacting the poles of a battery placed in said battery receptacle; and a flexible neck electrically, physically and flexibly connecting said lighting member to said base, said flexible neck including an elongated resilient body having a first end connected to said lighting member and a second end connected to said base, said resilient body having a plurality of parallel grooves formed laterally about the outer surface of said resilient body to facilitate bending of said flexible neck, a first conductor retaining a selected positional relationship between said lighting member and said base and electrically connecting said light source to said first battery terminal, and a second conductor assisting said first conductor in retaining a selected positional relationship between said lighting member and said base and electrically connecting said light source to said second battery terminal.

15. The illumination device as defined in claim 14, wherein said resilient body has first and second longitudinal holes extending from said first end to said second end, said first conductor is disposed in said first longitudinal hole through said resilient body, and wherein said second conductor is disposed in said second longitudinal hole through said resilient body.

16. The illumination device as defined in claim 15, wherein said resilient body has a third longitudinal hole extending from said first end to said second end, and wherein said flexible neck further includes dampening means disposed in said third longitudinal hole for dampening movement of said flexible neck.

17. The illumination device as defined in claim 16, wherein said dampening means is flexible conduit extending substantially uninterrupted between said first and second ends of said elongated resilient body and defining a passageway therebetween.

18. An illumination device comprising:

a lighting member for housing a first light source, a second light source, and a lens;

a base including a battery receptacle for receiving a battery and first and second battery terminals for respectively contacting the poles of a battery placed in said battery receptacle;

a flexible neck physically and flexibly connecting said lighting member to said base, said flexible neck including an elongated resilient body having a first end connected to said lighting member and a second end connected to said base, said resilient body having a plurality of parallel grooves formed laterally about the outer surface of said resilient body to facilitate bending of said flexible neck, a first conductor for retaining a selected positional relationship between said lighting member and said base and for electrically connecting said light source to said first battery terminal a second conductor for assisting said first conductor in retaining a selected positional relationship between said lighting member and said base and for electrically connecting said light source to said second battery terminal, and a third conductor for electrically connecting said second light source to said first battery terminal.

19. The illumination device as defined in claim 18 and further including switching means for selectively providing power from at least one battery placed in said battery receptacle to one or both of said first and second light sources.

20. The illumination device as defined in claim 19, wherein said switching means includes a first switch mounted on said base and coupled between said first battery terminal and said first light source, and a second switch mounted on said lighting member and coupled between said third conductor and said second light source.

21. The illumination device as defined in claim 14 and further including a switch coupled to said first conductor for selectively supplying power to said light source.

22. The illumination device as defined in claim 21, wherein said switch is mounted on said light housing.

23. The illumination device as defined in claim 21, wherein said switch is mounted on said base.

24. A flexible neck for physically and flexibly connecting a lighting member to a base of an illumination device, said flexible neck comprising:

an elongated resilient body having a first end connected to the lighting member and a second end connected to the base;

retention means for retaining a selected positional relationship between the lighting member and the base; and dampening means extending between said first and second ends of said elongated resilient body for dampening movement of said flexible neck.

25. The flexible neck as defined in claim 24, wherein said resilient body has first and second longitudinal holes extending from said first end to said second end, said retention means is disposed in said first longitudinal hole through said resilient body, and wherein said dampening means is disposed in said second longitudinal hole through said resilient body.

26. The flexible neck as defined in claim 24, wherein said dampening means is flexible conduit.

27. The flexible neck as defined in claim 24 further including second retention means.

28. The flexible neck as defined in claim 27, wherein said first and second retention means are each formed of a metal rod.

29. The flexible neck as defined in claim 28, wherein said first and second longitudinal holes and said metal rods have substantially the same diameter.

30. The flexible neck as defined in claim 24, wherein said retention means is formed of metal rod.

31. The flexible neck as defined in claim 24, wherein said resilient body is formed of hard rubber.

32. A flexible neck for physically and flexibly connecting a lighting member to a base of an illumination device, said flexible neck comprising:

an elongated resilient body formed of hard rubber having a first end connected to the lighting member and a second end connected to the base, said resilient body having a plurality of parallel grooves formed laterally about the outer surface of said resilient body to facilitate bending of said flexible neck;

a first metal rod retaining a selected positional relationship between the lighting member and the base and providing an electrical connection between the lighting member and the base; and a second metal rod assisting said first metal rod in retaining a selected positional relationship between the lighting member and the base and providing a second electrical connection between the lighting member and the base.

33. The flexible neck as defined in claim 32, wherein said resilient body has first and second longitudinal holes extending from said first end to said second end, said first metal rod is disposed in said first longitudinal hole through said resilient body, and wherein said second metal rod is disposed in said second longitudinal hole through said resilient body.

34. The flexible neck as defined in claim 32 and further including dampening means for dampening movement of said flexible neck.

35. The flexible neck as defined in claim 34, wherein said dampening means is flexible conduit.

36. The flexible neck as defined in claim 33, wherein said first and second longitudinal holes and said first and second metal rods have substantially the same diameter.

37. An illumination device comprising:

a first light source;

a second light source;

a light housing for housing said first light source and said second light source;

a base including a battery receptacle for receiving a battery and first and second battery terminals for respectively contacting the poles of a battery placed in said battery receptacle;

a flexible neck physically and flexibly connecting said light housing to said base;

a first conductor disposed within said flexible neck for electrically connecting said first light source to said first battery terminal;

a second conductor disposed within said flexible neck for electrically connecting said second light source to said first battery terminal; and a third conductor disposed within said flexible neck for electrically connecting said first and second light sources to said second battery terminal.

38. The illumination device as defined in claim 37 and further including:

a first switch coupled between said first light source and said first conductor for selectively enabling power to be supplied from a battery in said battery receptacle to said first light source; and a second switch coupled between said second light source and said second conductor for selectively enabling power to be supplied from a battery in said battery receptacle to said second light source.

39. The illumination device as defined in claim 38, wherein said first switch is disposed on said light housing and said second switch is disposed on said base.

40. The illumination device as defined in claim 37 and further including:

a lens mounted on an end of said light housing for projecting illumination from said first light source to a spot so as to enable the illumination device to function as a flashlight when said first switch is actuated; and a diffusing lens mounted on said light housing and constituting a part thereof for dispersing diffused illumination from said second light source over a wide area so as to enable the illumination device to function as an area lamp when said second switch is actuated.

41. An illumination device comprising:

a first light source;

a second light source;

a light housing for housing said first light source and said second light source, said light housing including a lens for focusing illumination from said first light source to a spot and a diffusing lens for dispersing diffused illumination from said second light source over a wide area;

a base; and a flexible neck physically and flexibly connecting said light housing to said base such that said light housing may be selectively positioned to function as either an area lamp or a flashlight.

42. The illumination device as defined in claim 41 and further including coupling means for selectively coupling said light housing onto said base.

43. The illumination device as defined in claim 41, wherein said base includes a battery receptacle for receiving a battery and battery terminals for contacting the poles of a battery placed in said receptacle, and wherein said flexible neck provides an electrical pathway for electrically coupling said battery terminals to said first and second light sources to selectively supply power to said first and second light sources from at least one battery placed in said battery receptacle.

44. The illumination device as defined in claim 41, wherein said flexible neck includes:

an elongated resilient body having a first end connected to said light housing and a second end connected to said base, said resilient body having first and second longitudinal holes extending from said first end to said second end;

retention means disposed in said first longitudinal hole through said resilient body to retain a selected positional relationship between said light housing and said base; and dampening means disposed in said second longitudinal hole through said resilient body for dampening movement of said flexible neck.

45. The illumination device as defined in claim 41 and further including switching means for selectively providing power from at least one battery placed in said battery receptacle to one or both of said first and second light sources.

46. The illumination device as defined in claim 45, wherein said switching means includes:

a first switch mounted on said light housing for selectively providing power to said first light source; and a second switch mounted on said base for selectively providing power to said second light source.

* * * * *